US005820126A

United States Patent [19]

Moore

[11] Patent Number: 5,820,126

[45] Date of Patent: Oct. 13, 1998

[54] SPACE BATTLE GAME

[76] Inventor: Ronnie Moore, 724 Austin Ave., Madera, Calif. 93638

[21] Appl. No.: 921,415

[22] Filed: Aug. 29, 1997

[51] Int. Cl.[6] ..... A63F 3/00

[52] U.S. Cl. ..... 273/253

[58] Field of Search ..... 273/236, 248, 273/250, 253

[56] References Cited

U.S. PATENT DOCUMENTS

| | | | |
|---|---|---|---|
| 3,373,995 | 3/1968 | Fors | 273/250 |
| 3,533,628 | 10/1970 | Fisher | 273/250 |
| 3,674,273 | 7/1972 | Sells | 273/253 X |
| 4,395,044 | 7/1983 | Hula | 273/253 |
| 4,695,056 | 9/1987 | Cornelson et al. | 273/253 X |
| 4,946,169 | 8/1990 | Hofman | 273/253 |
| 5,037,109 | 8/1991 | Bowen | 273/253 |

*Primary Examiner*—William E. Stoll
*Attorney, Agent, or Firm*—Richard A. Ryan

[57] ABSTRACT

A space battle game having a playing board with a planet located near the center of the board. Rings circle the planet at or near its equator. On opposite sides of the planet are located opposing battle base areas where each opponent places a set of battle base pieces that form each player's battle base. Located near each player's battle base area are launch pads for placement of the player's spacecraft. Each player has a designated number of spacecraft of the same design and color. The goal of the game is to destroy the opponent's battle base and spacecraft by maneuvering spacecraft to be adjacent to the opposing battle base and spacecraft. Dice are used to move the spacecraft across the board and to determine the outcome of the battles between opposing spacecraft or between a spacecraft and a battle base. The spacecraft cannot cross the planet or rings except at designated pathways that must be entered and exited on exact rolls. The spacecraft are provided with a missile for firing at a longer range and have shields to protect them from attack. The shields can be replaced after their loss by passing through designated zones on the board.

20 Claims, 3 Drawing Sheets

SPACE BATTLE GAME

BACKGROUND OF THE INVENTION

1. Field of the Invention

The field of the present invention relates generally to board games and, more particularly, to board games involving a combination of luck and logic to defeat the opposing player. Even more particularly, the present invention relates to board games set in an astronomical setting with battles between opposing spacecraft and battle bases that result in point accumulation for the players.

2. Background

Space travel and space conquest board games are generally well known. Many of the related art board games utilize a board having a continuous path that the player's pieces follow as they travel through a solar system. An example of such a game is found in U.S. Pat. No. 4,575,095 to Gaster. Other board games utilize game pieces representing spacecraft that have the ability to fire on the opposing player's spacecraft, by way of randomly selected indicators of relative strength or power, causing the losing spacecraft to be removed from the board. Examples of this type of game can be found in U.S. Pat. No. 4,385,765 to Munn, et al., and U.S. Pat. No. 4,157,184 to Recard.

All of the related art games contain various features and characteristics in the rules, game pieces, game board or method of play to distinguish one game from other games. Most of the games are based primarily on chance and do not allow the individual player to develop and execute strategies that enable him or her to defeat the opposing player through application of such strategies. Prior art games that do allow application of conquest strategies, do not utilize multiple player pieces and a battle base comprised of multiple components that requires the players to utilize their playing pieces to formulate a multiple level attack on the opposing game pieces and battle base to accomplish an objective of destroying those opposing game pieces and battle base. None of the related art references appear to teach or suggest a game having all the elements and features of the present invention.

SUMMARY OF THE INVENTION

The space battle game of the present invention presents a new game set in outer space that combines intellectual strategy with a certain element of chance. The present invention requires each player to coordinate a multiple piece attack on the opposing player's moveable pieces and stationary battle base. This requires each player to develop game strategies that allows them to move their game pieces across the board, battle their opponents and accumulate points from the destruction of opposing spacecraft and battle base, while attempting to avoid destruction of their own game pieces and battle base.

The game of the present invention utilizes moveable player pieces that represent spacecraft and that are shaped or colored, or both, to distinguish one player's pieces from the other player's pieces (or, if team play, from the other team's pieces). Each player has a battle base made up of individual pieces. At the commencement of the game, the spacecraft and battle base pieces are placed on opposing sides of the game board. In the middle of the game board is a planet having rings around the planet near the planet's equator (similar to Saturn's rings). Around the planet and rings are a number of small moons having separately identifiable color coded centers. Across the center of the planet and across the rings, near the ends away from the planet, are pathways that allow the spacecraft to cross the planet and rings, which cannot be crossed otherwise. Also located on the game board are multiple pathways that allow a spacecraft to move without being attacked. The remaining game board layout primarily includes a number of cells representing open space and several non-passable areas (i.e., asteroid clusters).

Once the game begins, each player utilizes a chance mechanism, such as dice, to move the spacecraft across the board to attack the opponent's spacecrafts and battle base. Spacecraft can only be moved vertically or horizontally through the open space cells. Diagonal movement of the spacecraft requires passage through and along the various pathways. The spacecraft can be moved through the open space cells or along the various pathways. The spacecrafts cannot cross the planet or its rings, except along the pathways, and cannot pass through the moons or any asteroid clusters. The spacecraft can be maneuvered next to an opposing spacecraft to engage in a battle or moved to attack the opponent's battle base.

In attack and defend mode, the chance mechanism is activated (i.e., the dice are thrown) by both players. The player with the highest number wins the battle. Initially, the losing spacecraft merely loses its shield. On the second hit, the spacecraft is removed from the board. When a spacecraft attacks the opposing battle base by moving adjacent to one of the battle base pieces, the players activate the chance mechanism and the player with the higher number wins the battle. This results in the loss of either a base piece, the shield of a spacecraft still having its shield or the removal of an unshielded spacecraft from the board. A major objective of the game is to destroy the opponent's battle base and as many spacecraft as possible to accumulate points. The player who destroys the opponents battle base first wins the game. If one player loses all of its spacecraft before his or her battle base is destroyed, then the player with the most points wins the game.

The game includes the use of one or more missiles on each spacecraft that allow the player to attack from a distance (i.e., without having to move adjacent to an opposing spacecraft or battle base piece). A missile can be fired by utilizing a chance mechanism that determines how far the missile travels. If the missile travels sufficient distance to hit an opposing spacecraft or battle base piece, then the missile destroys the opposing piece or the spacecraft's shield (if it has one). If the missile does not travel sufficient distance, then it is harmlessly removed from the board.

The game also utilizes chance cards that a player must draw if he or she lands on certain designated places in the pathway that crosses near the center of the planet. The chance cards instruct the player to move his or her spacecraft to a certain location, such as adjacent to the opponent's battle base or to one of the moons, or lose its shield. Other chance cards direct the player to move his or her spacecraft elsewhere, with certain consequences (i.e., destruction). At the corners of the game board are located remote sector locations that one player's spacecraft must be moved to if an opposing player's spacecraft lands on top of the first player's spacecraft (referred to as being "pounced" on) while it is in one of the pathways. If a spacecraft is pounced on while in the remote sector, it is terminated.

Accordingly, the primary objective of the present invention is to provide an interesting and challenging space battle game that comprises a game board, spacecraft pieces and a battle base in a game that combines intellectual strategy and chance.

It is also an important objective of the present invention to provide a space battle game having spacecraft playing pieces that move across a game board to attack the opposing player's moveable spacecraft playing pieces and stationary battle base.

It is also an important objective of the present invention to provide a space battle game having opposing spacecraft and battle bases that are able to battle each other by utilizing methods of chance to determine the winner of each battle.

It is also an objective of the present invention to provide a space battle game where the opposing spacecraft must maneuver around impenetrable objects, such as planets, planetary rings and asteroid clusters, and be able to cross such objects at selected positions on the game board in order to do battle with opposing spacecraft and battle base.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

Figure 1:
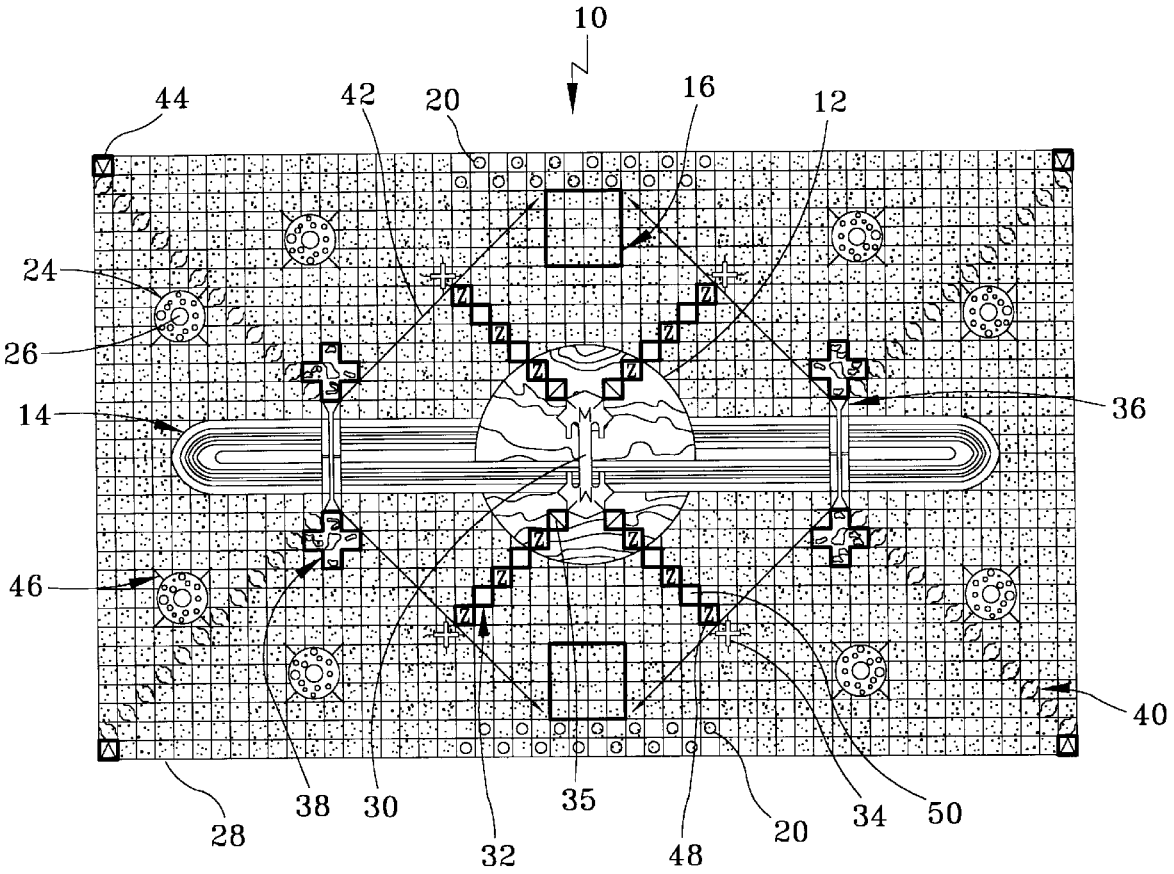
FIG. 1 illustrates the game board according to the present invention.

With reference to the figures where like elements have been given like numerical designations to facilitate the reader's understanding of the present invention, the preferred embodiment of the present invention is set forth below. The space battle game of the present invention includes a game board 10 having a representation of a planet 12 at or near the center of the game board. Around the approximate equatorial region of planet 12 is a ring system 14 similar to that found on the planet Saturn in our own solar system. Located on board 10 near, but spaced away from, each polar region of planet 12 is a battle base marker 16 that designates the location of each player's battle base 18. Located near battle base marker 16 is a number of launch pads 20 for launching each player's spacecraft, designated as 22 and 23. Surrounding the planet and its rings are a number of moons 24 designated with color centers 26 that distinguish each moon 24 from the other moons. In the basic version of the present invention, the remaining space around the planet, rings and moons is designated with square cells representing open space 28.

In the preferred embodiment, game board 10 further comprises several pathways across planet 12 and its rings 14. The path across the center of planet 12, referred to as the mid warp and designated 30, is connected by two warp zone paths 32 on each side of planet 12 that allows any spacecraft 22 and 23 that enters one of paths 32 at an entry/exit warp passage point 34 to exit out the opposite side of planet 12. The warp zone paths 32 connect to the mid warp 30 at warp port 35. The pathway across rings 14 is referred to as the trisect zone and is designated 36.

Game board 10 also comprises an asteroid cluster 38 that spacecraft 22 and 23 cannot pass through, a shield field pathway 40, a trisect push indicator line 42 connected to one end of trisect zone 36, and remote sectors 44 in each corner of board 10. Moons 24 have moon exits 46 that exit to open space 28. Encompassed within warp zone paths 32 are zap spaces 48, designated with a "Z" on board 10. Neutral spaces 50 are left unmarked and can have a color different than zap spaces 48 to further distinguish the various spaces in warp zone paths 32.

Figure 2:
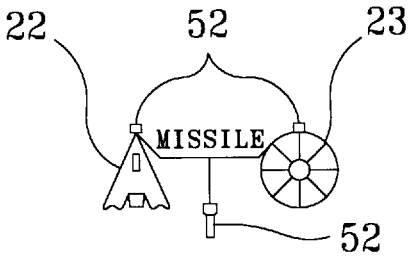
FIG. 2 illustrates one embodiment of the player pieces utilized to represent opposing spacecraft.

Spacecraft 22 and 23 can be made into different shapes, as shown in FIG. 2, and be of different colors to designate the association of the spacecraft with an individual player. The bottom surface of spacecraft 22 and 23 can be a different color than the top surface to designate when spacecraft 22 and 23 have lost their shields. One configuration, is to have the bottom surface of both spacecraft 22 and 23 painted white to indicate a ship not having a shield (therefore, only the shape of the spacecraft would distinguish the opposing player pieces).

Figure 5:
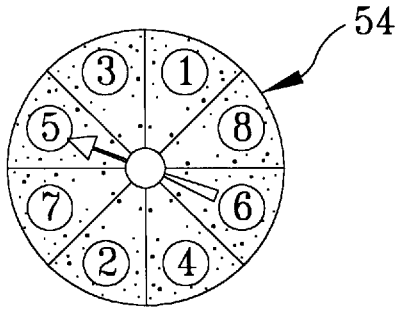
FIG. 5 is one embodiment of a chance device for use to determine the length of travel of a missile fired from a player's spacecraft.

Spacecraft 22 and 23 can be configured to receive one or more removable missiles 52. Alternatively, spacecraft 22 and 23 can be configured to include a means of indicating missile 52 status, such as a colored switch, that would indicate to players whether a spacecraft 22 or 23 has fired all of their missiles 52 or not. To determine the number spaces that missile 52 moves after being fired from spacecraft 22 or 23, the present invention includes a missile spinner 54, shown in FIG. 5, capable of randomly selecting and indicating a number of spaces.

Figure 3:
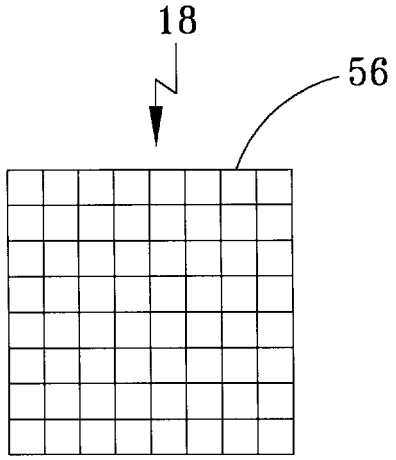
FIG. 3 illustrates one embodiment of the battle base.
Figure 4:
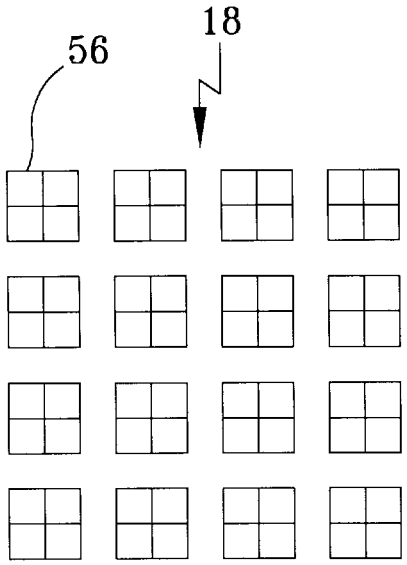
FIG. 4 is an exploded view of the battle base illustrated in FIG. 3.

As shown in FIGS. 3 and 4, battle base 18 comprises a number of individual battle base pieces 56 that are placed together to form battle base 18 in battle base marker 16. In the preferred embodiment, battle base 18 is comprised of sixteen (16) battle base pieces 56. If the space station pieces 56 are made to be connectable, they should be capable of becoming disconnected as the game progresses. Battle base 18 can be made of plastic or any other suitable material and be of a color that corresponds to that player's spacecraft to further identify battle base 18 and spacecraft 22 or 23 with a particular player.

Figure 6A:
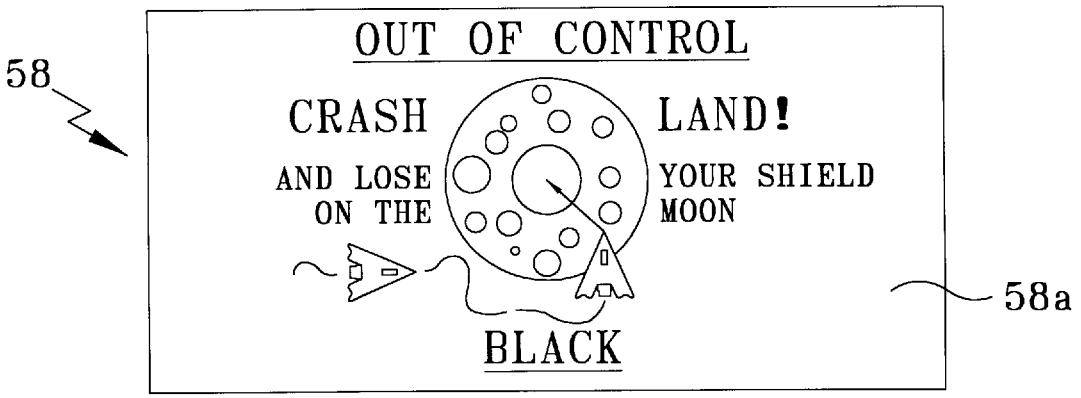
FIG. 6*a* through 6*c* illustrate three example chance cards utilized with the present invention.
Figure 6B:
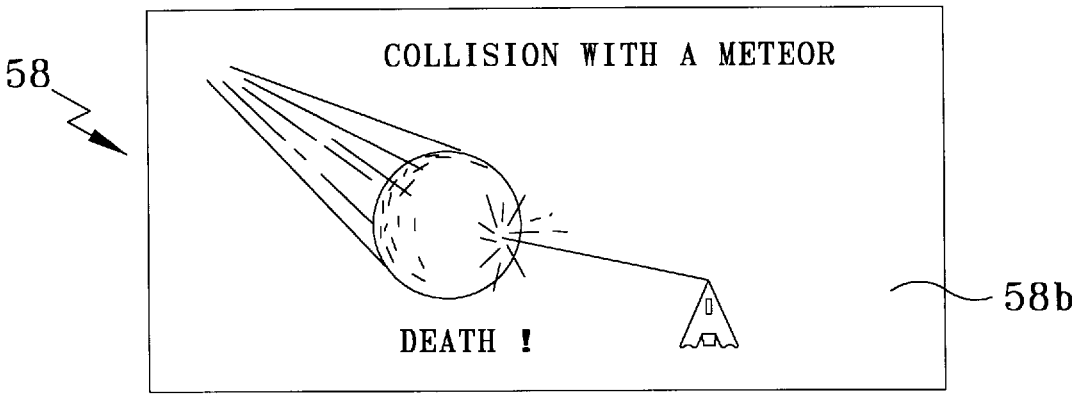
Figure 6C:
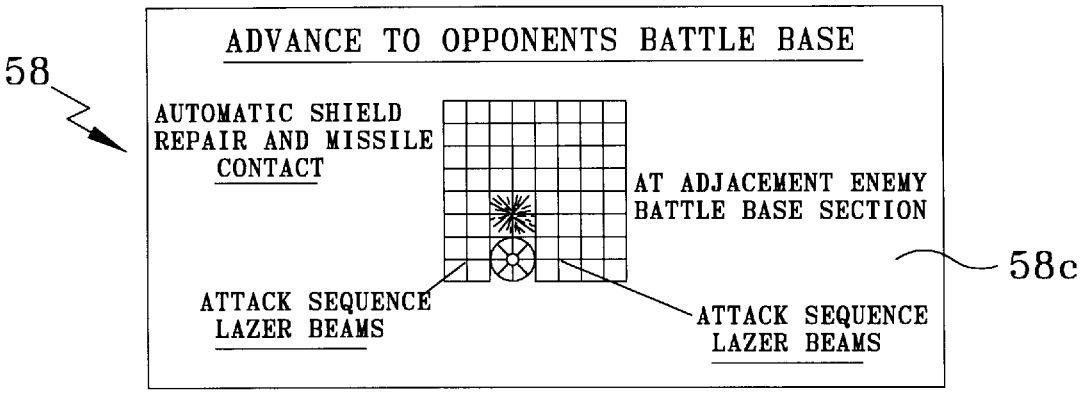

Also included with the space battle game of the present invention are zap cards (designated generally as 58). Zap cards 58 provide instructions to the player whose piece lands on a zap space 48. Examples of three zap cards 58*a*, 58*b* and 58*c* are illustrated in FIG. 6*a*, 6*b* and 6*c*, respectively. Zap card 58*a* informs the player that his or her spacecraft 22 or 23 has crash landed on one of moons 24. The player should move spacecraft 22 or 23 to particular moon 24 designated by color coded center 26 (black in this example). Zap card 58*b* informs the player that his or her spacecraft has had a collision with a meteor and is terminated (taken off the board 10). Zap card 58*c* informs the player that his or her spacecraft should be moved next to the opponent's battle base 18 and that its shield is repaired and missile fired into a battle base piece 56. It should be understood that the three zap cards 58 shown in FIG. 6*a*, 6*b* and 6*c* and discussed above are merely illustrative of the information that can be contained on the zap cards 58.

At the commencement of the game, each player or team of players places their spacecraft 22 or 23 on launch pads 20 nearest their battle base marker 16 and places the battle base pieces 56 together in their battle base marker 16 to form a battle base 18. The preferred embodiment of the present invention utilizes fourteen of each spacecraft 22 and 23 and sixteen battle base pieces 56 for each battle base 18. Missiles 52 are loaded into spacecraft 22 and 23 and zap cards 58 are shuffled and placed face down. After deciding which player goes first, the players take turns moving their spacecraft 22 or 23 out of the launch pads 20 and towards their opponents battle base 18. The spacecraft 22 and 23 cannot cross the planet 12 or rings 14 except through the warp zone paths 32 and trisect zones 36. Spacecraft 22 and 23 also cannot move through moons 24, asteroid cluster 38 or remote sectors 44, cannot cross the warp zone paths 32 horizontally or vertically and cannot pass over a battle base 18.

At the beginning of each player's turn, the player throws or rolls one of a pair of dice and moves the number of open space cells 28 indicated thereon. In the open space cells 28, the spacecraft 22 and 23 can only move vertically or horizontally, as selected by the player. If the player moves his or her spacecraft 22 or 23 next to the opponent's spacecraft 22 or 23, then a battle involving laser beams must ensue. The two spacecraft 22 and 23 battle by each player rolling the dice. The player having the higher number wins the battle and continues his or her turn. If the losing spacecraft 22 or 23 still has its shield, the spacecraft 22 or 23 is turned over so the different colored bottom surface is facing upward to indicate the loss of its shield. If a spacecraft 22 or 23 is hit by a laser beam or missile 52 after losing its shield, then it is terminated and removed from the board 10.

If spacecraft 22 or 23 makes it to the opposing battle base 18 and moves adjacent to one or more of the battle base pieces 16, then a battle using lasers ensues between the spacecraft 22 or 23 and battle base 18. As with a battle between spacecraft 22 or 23, the winner of the battle is determined by the roll of the dice. If spacecraft 22 or 23 wins the battle, the base piece 16 is removed from the board and, if spacecraft 22 or 23 has its shields or is adjacent to an opposing base piece 16 or spacecraft 22 or 23, the attacking player continues his or her turn. If the battle base 18 wins the battle, the spacecraft 22 or 23 either loses its shield or is terminated.

The player can fire a missile 52 from its spacecraft 22 or 23 when he or she rolls a one. Missiles 52 can be fired horizontally or vertically from the spacecraft 22 or 23 and move a distance determined by the spin of missile spinner 54. If the missile 54 goes far enough to hit an opposing spacecraft 22 or 23 or a battle base piece 16 then the effect is the same as winning a battle unless the spacecraft 22 or 23 firing the missile 52 does not have its shield, in which case the player's turn is over. If the missile 52 fails to go far enough to hit its target, then the missile is removed from the game without causing any damage to the opponent and the player's turn is over. Missiles 52 cannot be fired in or out of warp passage point 34, remote sector 44, trisect zone 36 or shield field pathway 40.

Spacecraft 22 and 23 can travel through warp zone paths 32 to get to mid warp 30 and then on to the other side of planet 12. To get a spacecraft 22 or 23 onto the warp zone path 32, a player must roll the exact number to land on warp passage point 34. Any spacecraft 22 or 23 that is pounced on while on warp zone path 32 is terminated. The zap spaces 48 on the player's side of the planet 12 are neutral for that player, however, on the opposing side of planet 12 the player must draw and respond to the zap card 48. Once in warp zone path 32 a spacecraft 22 or 23 can pass over or pounce on an opponents spacecraft 22 or 23. To enter mid warp 30, the player must roll the exact number, counting mid warp 30 as one space. To exit mid warp 30 the player must roll a one to move onto either warp port 35, where the player must roll again and move onto a zap space 48 or neutral space 50 or move out of warp zone path 32 when able to.

A quick way to cross to the other side of planet 12 is to utilize the trisect zone 36. To enter trisect zone 36, a player must roll the exact number. To pass through the opposite side of trisect zone 36, the player must roll a three. The player can exit trisect zone 36 to the side he or she entered from at any time it is their turn. The trisect push line 42 is utilized to move quickly from the trisect zone 36 to the opposing side's battle base 18 by a player maneuvering two spacecraft 22 and 23 such that one is at each end of the trisect zone 36 and then rolling a three. The spacecraft 22 or 23 on the opponent's side of planet 12 is "pushed" to the opponent's battle base 18. At the battle base 18, the player pounces on (i.e., destroys) any opposing spacecraft 22 or 23 in that space and must attack an opposing spacecraft 22 or 23 in any space adjacent to that space, before attacking the adjacent battle base piece 16. If opposing spacecraft 22 or 23 are on either side of trisect zone 36 and one of the players rolls a three, the other player's spacecraft 22 or 23 is "pushed" to the remote sector 44 on the same side. If a spacecraft 22 or 23 is already in remote sector 44 when another spacecraft 22 or 23 is sent there, at any time, the first spacecraft 22 or 23 is terminated.

A spacecraft 22 or 23 that does not have its shield is protected from destruction while in the shield field pathway 40. Although a spacecraft 22 or 23 may pass through the shield field pathway 40 at any time, if a spacecraft 22 or 23 enters the shield field pathway 40 it must exit at the trisect zone 36. A spacecraft 22 or 23 can regain its shield by exiting a moon 24 on a roll of one, passing through the trisect zone 36 in either direction, by moving into mid warp 30 or by entering its opponent's warp passage point 34 and making it to the warp port 35 (where the player will then have a forced roll).

The game is over when one opponent destroys his or her opponent's battle base 18, making him or her the winner of the game. If one player loses all of his or her spacecraft 22 or 23, then the game is over and the winner is determined by points. Each remaining battle base piece 16 is worth five points, each shielded spacecraft 22 or 23 is worth 2 points and each unshielded spacecraft 22 or 23 is worth 1 point. The player destroying all of his or her opponent's spacecraft 22 or 23 gets a five point bonus.

While there is shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape and use.

What is claimed is:

1. A space battle game, comprising:

a game board having a planet figure located in the center of said game board, at least one equatorial ring around said planet figure, a plurality of moon figures spatially located around said planet figure and said at least one equatorial ring, a plurality of open space cells, a first battle base marker, a second battle base marker, a plurality of first launch pads and a plurality of second launch pads, said first battle base and said first launch pads located on a side of said planet figure opposite said second battle base and said second launch pads;

a plurality of first player pieces, said first player pieces representing spacecraft identifiable with a first player, each of said plurality of first player pieces located in one of said first launch pads at the commencement of the game;

a plurality of second player pieces, said second player pieces representing spacecraft identifiable with a second player, each of said plurality of second player pieces located in one of said second launch pads at the commencement of the game;

a first battle base, said first battle base comprising a plurality of first base pieces, said first battle base removably located in said first base marker at the commencement of the game, said first battle base identifiable with said first player;

a second battle base, said second battle base comprising a plurality of second base pieces, said second battle base removably located in said second base marker at the commencement of the game, said second battle base identifiable with said second player;

first chance means for alternatively determining the number of said open space cells said first player may move said first player pieces during said first player's turn and said second player may move said second player pieces during said second player's turn; and second chance means for determining the relative strength of said first player pieces and said second player pieces when said first and second player pieces engage in a battle, said second chance means also for determining the relative strength of said first player pieces and said second base pieces when one of said first player pieces is engaged in battle with one of said second base pieces and for determining the relative strength of said second player pieces and said first base pieces when one of said second player pieces is engaged in battle with one of said first base pieces.

2. The space battle game according to claim 1, wherein said first player pieces are of a common color and shape and said second player pieces are of a common color and shape, said color and shape of said second player pieces being different than said color and shape of said first player pieces, said first battle base being the same color as said first player pieces and said second battle base being the same color as said second player pieces.

3. The space battle game according to claim 1, wherein said first and second player pieces each comprise two distinguishing colors, a first color representing the player to which said first and second player pieces belong and a second color representing a spacecraft with its shield gone.

4. The space battle game according to claim 1, wherein said first and second player pieces each comprise at least one missile removably located in said first and second piece.

5. The space battle game according to claim 4 further comprising third chance means for determining the number of said open space cells that said at least one missile will transverse when fired from either of said first and second player pieces.

6. The space battle game according to claim 5, wherein said third chance means is a spinner having a pointer and a plurality of numbers.

7. The space battle game according to claim 1, wherein said first chance means and said second chance means are a pair of dice.

8. The space battle game according to claim 1, wherein each of said moon figures comprises a colored center section, said colored center section on each of said moon figures different than each other colored center section on each other of said moon figures.

9. The space battle game according to claim 1, wherein said open space cells are square.

10. The space battle game according to claim 1, wherein said game board further comprises at least one warp zone path and a mid warp, said mid warp located near the center of said planet figure, said warp zone path connecting at one end to said mid warp to allow said first player pieces and said second player pieces to transverse said planet.

11. The space battle game according to claim 10, wherein said warp zone path comprises a warp port connecting said warp zone path to said mid warp, a warp passage point opposite said warp port for entry and exit into said warp zone path, at least one zap space, and at least one neutral space.

12. The space battle game according to claim 11 further comprising a plurality of zap cards having instructions for movement or removal of any of said first player pieces or said second player pieces that land on said zap space.

13. The space battle game according to claim 1 further comprising a trisect zone path to allow said first player pieces and said second player pieces to transverse said equatorial ring.

14. The space battle game according to claim 13 further comprising a remote sector in each corner of said game board and a shield field pathway interconnecting said remote sector and one end of said trisect zone path.

15. A space battle game, comprising:

a game board having a planet figure located in the center of said game board, at least one equatorial ring around said planet figure, a plurality of moon figures spatially located around said planet figure and said at least one equatorial ring, a plurality of open space cells, a first battle base marker, a second battle base marker, a plurality of first launch pads and a plurality of second launch pads, said first battle base and said first launch pads located on a side of said planet figure opposite said second battle base and said second launch pads;

a plurality of first player pieces, said first player pieces representing spacecraft having a common color and shape identifiable with a first player, each of said plurality of first player pieces located in one of said first launch pads at the commencement of the game;

a plurality of second player pieces, said second player pieces representing spacecraft having a common color and shape identifiable with a second player, said color and shape of said second player pieces different than said color and shape of said first player pieces, each of said plurality of second player pieces located in one of said second launch pads at the commencement of the game;

a first battle base, said first battle base comprising a plurality of first base pieces, said first battle base removably located in said first base marker at the commencement of the game, said first battle base identifiable with said first player;

a second battle base, said second battle base comprising a plurality of second base pieces, said second battle base removably located in said second base marker at the commencement of the game, said second battle base identifiable with said second player;

first chance means for alternatively determining how many cells said first player may move said first player pieces during said first player's turn and said second player may move said second player pieces during said second player's turn;

second chance means for determining the relative strength of said first player piece and said second player piece when said first and second player pieces engage in a battle, said second chance means also for determining the relative strength of said first player pieces and said second base pieces when one of said first player pieces is engaged in battle with one of said second base pieces and for determining the relative strength of said second player pieces and said first base pieces when one of said second player pieces is engaged in battle with one of said first base pieces;

a mid warp located near the center of said planet figure;

at least one warp zone path, said warp zone path connecting at one end to said mid warp to allow said first player pieces and said second player pieces to transverse said planet; and a trisect zone path to allow said first player pieces and said second player pieces to transverse said equatorial ring.

16. The space battle game according to claim 15, wherein said warp zone path comprises a warp port connecting said warp zone path to said mid warp, a warp passage point opposite said warp port for entry and exit into said warp zone path, at least one zap space, and at least one neutral space.

17. The space battle game according to claim 16 further comprising a plurality of zap cards having instructions for movement or removal of any of said first player pieces or said second player pieces that land on said zap space.

18. The space battle game according to claim 15 further comprising a remote sector in each corner of said game board and a shield field pathway interconnecting said remote sector and one end of said trisect zone path.

19. A space battle game, comprising:

a game board having a planet figure located in the center of said game board, at least one equatorial ring around said planet figure, a plurality of moon figures spatially located around said planet figure and said at least one equatorial ring, a plurality of open space cells, a first battle base marker, a second battle base marker, a plurality of first launch pads and a plurality of second launch pads, said first battle base and said first launch pads located on a side of said planet figure opposite said second battle base and said second launch pads;

a plurality of first player pieces, said first player pieces representing spacecraft having a common color and shape identifiable with a first player, each of said plurality of first player pieces located in one of said first launch pads at the commencement of the game;

a plurality of second player pieces, said second player pieces representing spacecraft having a common color and shape identifiable with a second player, said color and shape of said second player pieces different than said color and shape of said first player pieces, each of said plurality of second player pieces located in one of said second launch pads at the commencement of the game;

a first battle base, said first battle base comprising a plurality of first base pieces, said first battle base removably located in said first base marker at the commencement of the game, said first battle base identifiable with said first player;

a second battle base, said second battle base comprising a plurality of second base pieces, said second battle base removably located in said second base marker at the commencement of the game, said second battle base identifiable with said second player;

first chance means for alternatively determining how many cells said first player may move said first player pieces during said first player's turn and said second player may move said second player pieces during said second player's turn;

second chance means for determining the relative strength of said first player piece and said second player piece when said first and second player pieces engage in a battle, said second chance means also for determining the relative strength of said first player pieces and said second base pieces when one of said first player pieces is engaged in battle with one of said second base pieces and for determining the relative strength of said second player pieces and said first base pieces when one of said second player pieces is engaged in battle with one of said first base pieces;

a mid warp located near the center of said planet figure;

at least one warp zone path, said warp zone path connecting at one end to said mid warp to allow said first player pieces and said second player pieces to transverse said planet, said warp zone path comprising a warp port connecting said warp zone path to said mid warp, a warp passage point opposite said warp port for entry and exit into said warp zone path, at least one zap space and at least one neutral space;

a plurality of zap cards having instructions for movement or removal of any of said first player pieces or said second player pieces that land on said zap space; and a trisect zone path to allow said first player pieces and said second player pieces to transverse said equatorial ring.

20. The space battle game according to claim 19 further comprising a remote sector in each corner of said game board and a shield field pathway interconnecting said remote sector and one end of said trisect zone path.

* * * * *